US008302552B2

(12) United States Patent
Dover

(10) Patent No.: US 8,302,552 B2
(45) Date of Patent: Nov. 6, 2012

(54) RETRACTABLE CAUTION FLAG FOR MOUNTING ON A VEHICLE

(75) Inventor: David Wayne Dover, Gilroy, CA (US)

(73) Assignee: David W. Dover, Gilroy, CA (US)

( * ) Notice: Subject to any disclaimer, the term of this patent is extended or adjusted under 35 U.S.C. 154(b) by 259 days.

(21) Appl. No.: 12/711,231

(22) Filed: Feb. 23, 2010

(65) Prior Publication Data

US 2011/0203510 A1 Aug. 25, 2011

(51) Int. Cl.
*G09F 17/00* (2006.01)
*B63B 45/00* (2006.01)

(52) U.S. Cl. ..... 116/173; 116/28 R

(58) Field of Classification Search ..... 116/28 R, 116/173, 174, 175; 40/591, 592, 607.04, 40/610; 248/161; 403/109.1, 109.2, 109.3, 403/377, 379.5
See application file for complete search history.

(56) References Cited

U.S. PATENT DOCUMENTS

| | | | | |
|---|---|---|---|---|
| 1,013,582 | A * | 1/1912 | Bedini | 116/2 |
| 1,714,333 | A * | 5/1929 | Voss | 116/324 |
| 1,896,832 | A * | 2/1933 | Wiley | 116/173 |
| 2,452,842 | A * | 11/1948 | Davis | 116/173 |
| 3,153,252 | A * | 10/1964 | Ricciardi | 15/144.4 |
| 3,225,734 | A * | 12/1965 | Bule | 116/173 |
| 3,602,188 | A * | 8/1971 | Penaflor | 116/324 |
| 3,675,616 | A * | 7/1972 | McInnis | 116/173 |
| 3,797,450 | A * | 3/1974 | Frisbee | 116/28 R |
| 3,933,117 | A * | 1/1976 | Maietta | 116/28 R |
| 3,946,699 | A * | 3/1976 | Mirshak | 116/174 |
| 4,161,723 | A * | 7/1979 | De Vittori | 340/323 R |
| 4,926,786 | A * | 5/1990 | White | 116/324 |
| 4,944,656 | A * | 7/1990 | Feng et al. | 116/173 |
| 5,280,270 | A * | 1/1994 | Correa et al. | 340/471 |
| 6,907,642 | B1 * | 6/2005 | Czipri | 16/367 |
| 7,059,264 | B1 * | 6/2006 | Hall et al. | 114/343 |
| 7,428,879 | B1 * | 9/2008 | White et al. | 116/303 |
| D620,822 | S * | 8/2010 | Schmitz et al. | D10/109.1 |
| 7,980,781 | B2 * | 7/2011 | Trice | 403/349 |
| 2007/0068445 | A1 * | 3/2007 | Priegel | 116/174 |
| 2008/0083099 | A1 * | 4/2008 | Jones | 24/458 |
| 2010/0214132 | A1 * | 8/2010 | Palazzo | 340/984 |

FOREIGN PATENT DOCUMENTS

WO WO 8905236 A1 * 6/1989

* cited by examiner

*Primary Examiner* — R. A. Smith

(57) ABSTRACT

An apparatus includes a housing unit having a hollow cylinder shape with a longitudinal slot and a short section of slot situated at a right angle to the longitudinal slot. A flagpole is inserted into the housing unit for movement within the housing unit, where the flagpole is completely contained within the housing unit at a first position. A lower guide is joined to the flagpole for guiding movement of the flagpole. A caution flag is joined to the flagpole proximate a flagpole end. At least one bracket assembly joins the apparatus to a vehicle. A compressible spring is disposed within the housing unit for driving the flagpole in a first direction to a second position to display the flag. A trigger lever extends through the longitudinal slot where a placement of the trigger lever in the short section of slot prevents the compressible spring from moving the flagpole.

11 Claims, 4 Drawing Sheets

RETRACTABLE CAUTION FLAG FOR MOUNTING ON A VEHICLE

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to boating equipment. More particularly, the invention relates to a retractable caution flag that mounts on a boat.

BACKGROUND OF THE INVENTION

The present invention is a caution flag for water sports safety. When a person participating in a water sport such as, but not limited to, water skiing or tubing falls into the water, the boat is required to fly an orange, 12-inch-by-12-inch caution flag to warn other boats in the area of the presence of a person in the water. The only safety flag currently available is a manually operated flag. In typical use of this currently known flag, one person on the boat is assigned the duty of holding the flag until the person skiing or tubing falls into the water when the person holding the flag raises the flag into the air. Or else, someone on the boat must find the flag after the person skiing or tubing has already fallen into the water and then lifts flag into the air. This requirement can sometimes be a nuisance to abide by; however, it is definitely an important requirement for the safety of the skiers and other people participating in water sports.

In view of the foregoing, there is a need for improved techniques for providing an automatic caution flag that can be attached to a boat.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic side view and FIG. 1B is a side perspective view;

FIG. 3A is a diagrammatic top view, and FIG. 3B is a diagrammatic side view.

Figure 1B:
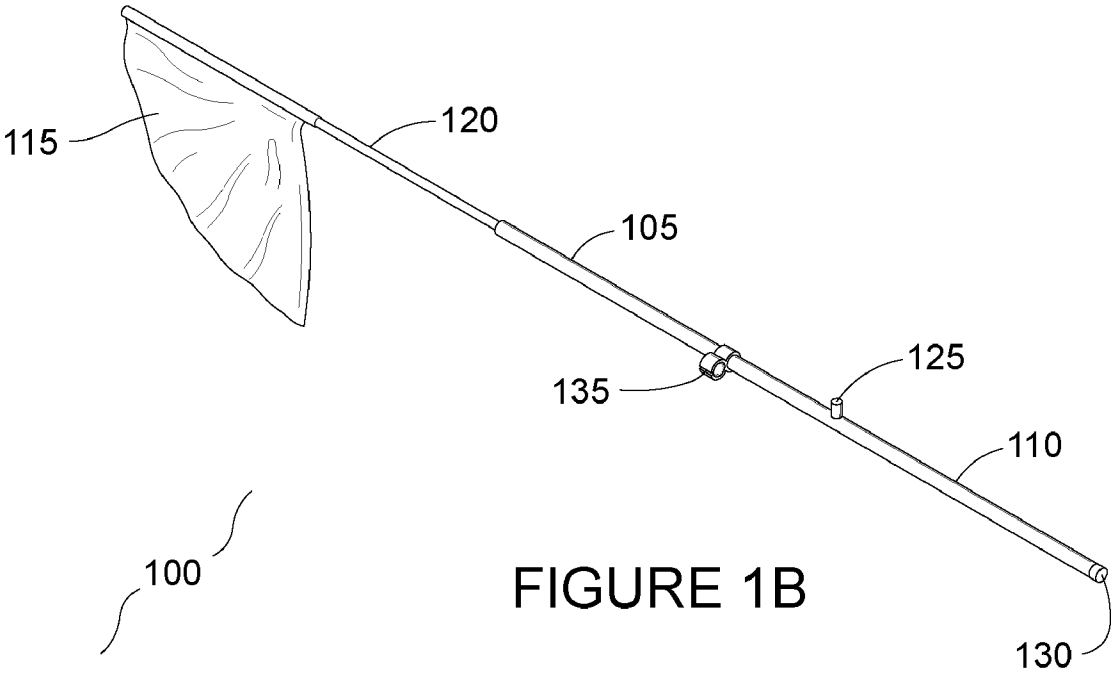
FIGS. 1A and 1B illustrate an exemplary retractable caution flag assembly ready to be mounted onto a boat, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide a hands free, retractable flag that easily mounts to a bimini top of a boat. A bimini top is an open-front cover for the cockpit of a boat, usually made of canvas supported by a metal frame. Most biminis can be collapsed when not in use, and raised again if shade or shelter from rain is desired. Preferred embodiments allow the flag to come up to warn other boaters of a person in the water. Preferred embodiments are usually mounted on the right side of the boat where the spotter sits. In the present embodiment when a skier or tuber falls into the water, the spotter releases a trigger and the flag pops out of a tube, and when the skier or tuber is up and skiing or tubing, the spotter retracts a lever and the flag goes back inside the tube.

Figure 1A:
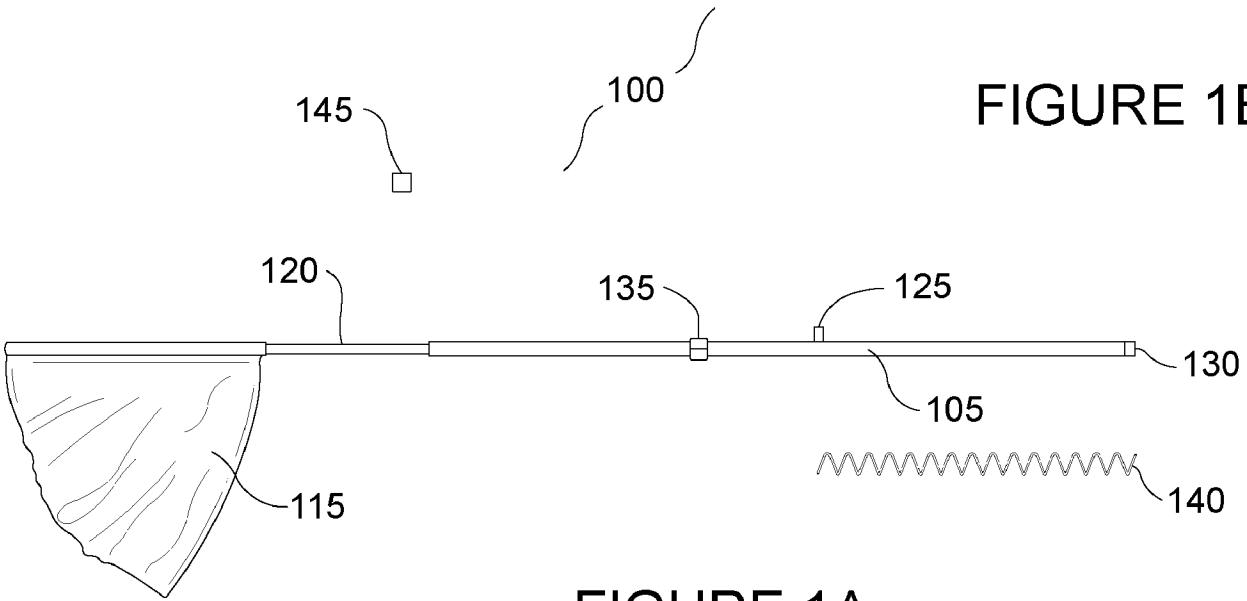

FIGS. 1A and 1B illustrate an exemplary retractable caution flag assembly 100 ready to be mounted onto a boat, in accordance with an embodiment of the present invention. FIG. 1A is a diagrammatic side view and FIG. 1B is a side perspective view. In the present embodiment, an aluminum housing unit 105 comprises a slot 110 with a range of motion which allows a flag 115 on a flagpole 120 to extend from housing unit 105. Aluminum housing unit 105 is preferably 36 inches in length by 1 and 1/16 inches in outside diameter and 13/16 of an inch in inside diameter. However, housing units in alternate embodiments may be various different sizes and may be made of various different materials. In the present embodiment, slot 110, which is cut into the side of housing unit 105, starts 6 and 3/8 inches from the bottom of housing unit 105 and ends 21 inches from the bottom of housing unit 105. At the bottom of slot 110, a short section of slot 110 is situated at a right angle to the rest of slot 110 to create a safety lock. In alternate embodiments the slot may be various different sizes and may be located in different places on the housing unit. In the present embodiment, a trigger lever 125 in slot 110, which is attached to flagpole 120, can be pulled down through slot 110 to compresses compression spring 140 in housing unit 105. At the bottom of slot 110, trigger lever 125 can be slid into the safety lock to lock flagpole 120 in a retracted position. When trigger lever 125 is released the flag extends into an upright warning position, as shown by way of example in FIGS. 1A and 1B. Trigger lever 125 may be made of various different materials including, but not limited to, aluminum, stainless steel, plastic, etc. Trigger lever 125 is preferably rounded at the end for safety with no sharp edges; however, trigger lever 125 may not be rounded. The other end of trigger lever 125 is threaded to be screwed into a lower guide for flagpole 120, shown by way of example in FIGS. 3A and 3B. In the present embodiment the top end of housing unit 105 is threaded on the outside to enable a safety and storage cap to screw onto the top of housing unit 105, and the bottom of housing unit 105 is threaded on the inside to enable a bottom plug 130 to screw into the bottom of housing unit 105. When threaded bottom plug 130 is threaded into the bottom of housing unit 105, it secures compression spring 140 in place.

Bottom plug 130 is preferably made of aluminum with all surfaces eased for safety. Bottom plug 130 has 1/4 of an inch of knurled surface for gripping to secure tightening and is threaded at the other end to match threads on the bottom of housing unit 105 in order to tighten into housing unit 105. In alternate embodiments, the bottom plug may be made of various different materials such as, but not limited to, different types of metal, plastic or rubber and may be attached to the bottom of the housing unit using various different means including, but not limited to, welding, set screws, friction, etc. In the present embodiment, bottom plug 130 has a small hole drilled through its center to release any water that may become trapped in housing unit 105 to generally prevent water damage. Bottom plug 130 holds compression spring 140 in housing unit 105. In the present embodiment, flag assembly 100 also has a cap 145 at the top of housing unit 105 as a safety device when not in use to generally prevent injury that may be caused by hitting the top of housing unit 105. Safety cap 145 is preferably made of aluminum and is used when mounting and removing flag assembly 100 to and from a boat. Safety caps in alternate embodiments may be made of various different materials such as, but not limited to, other metals, plastic, rubber, etc. In the present embodiment, safety cap 145 has threads cut into it to match threads cut at top of housing unit 105 and has a medium knurled outside surface for easy installation. Safety cap 145 prevents flag 115 from popping out of housing unit 105 if someone releases trigger lever 125 from its locked, retracted position, such as, but not limited to, when flag assembly 100 is being installed or is in storage. Safety cap 145 may be attached to the top of housing unit 105 using various different means such as, but not limited to, set screws, friction, etc. Safety cap 145 may also be used when the boat is not in use to keep water out of housing unit 105. Some embodiments of the present invention may not include a safety cap.

In the present embodiment, flag assembly 100 is attached to a bimini top of a boat with a clamp 135. Clamp 135 comprises two sides that are bolted together to create one single clamp. Clamp 135 is preferably made of aluminum and is 3 1/2 inches long by 1 inch wide. Clamp 135 has all edges cut at 45-degree angles to prevent sharp edges. The two sides of clamp 135 are held together with a seven-lobe knob with a threaded stud built into the knob that is screwed into a hole drilled through the center of each side of clamp 135; however the two pieces of clamp 135 may be held together using various different means such as, but not limited to, bolts, screws, etc. When bolted together, there is a hole at one end of clamp 135 that fits around housing unit 105 and a hole at the other to fit and around the railing of the bimini cover of the boat. In alternate embodiments the clamp may be sized to fit on various different locations on the boat such as, but not limited to, a ski pylon, ski tower, etc. In other alternate embodiments, the flag assembly may be attached to the boat using various different types of clamps or other attachment means such as, but not limited to, welding, rope, straps, bolts, screws, brackets, etc. In the present embodiment, flag assembly 100 is shown with one clamp 135; however, more clamps may be used to attach flag assembly 100 to the boat for example, without limitation, one at the top of housing unit 105 and one at the bottom of housing unit 105 for stability, as shown by way of example in FIG. 4. Clamp 135 can slide anywhere along housing unit 105 and anywhere on the boat bimini top or elsewhere on the boat to suit the boat and the preference of the user.

Flagpole 120 is preferably 5/16 of an inch round by 28 1/2 inches in length and is rounded on the end. Flagpole 120 is preferably made of aluminum. In alternate embodiments the flagpole may be various different sizes and may be made of various different materials including, but not limited to, different types of metal or plastic. In the present embodiment, flagpole 120 slides into an upper guide and the lower guide in housing unit 105, which help flagpole 120 move smoothly between the upright position and the retracted position. Flagpole 120 holds 12-inch-by-12-inch flag 115, which may be glued, sewn or otherwise attached to flagpole 120 to remain in place when moving between the upright and retracted positions.

Flagpole 120 is extended from the retracted position to the upright position by compression spring 140. Compression spring 140 is preferably made of stainless steel; however, various other metals may be used. Compression spring 140 is inserted into the bottom of housing unit 105 and stops against the lower guide on flagpole 120. Then, bottom plug 130 is screwed into the bottom of housing unit 105 to keep compression spring 140 in place. When trigger lever 125 is removed from the safety lock, flag 115 pops out of the top of housing unit 105 due to the force of the expansion of compression spring 140. When trigger lever 125 is pressed down, spring 140 compresses until trigger lever 125 is slid into the safety lock and is ready to release and pop flag 115 out of housing unit 105 again. Compression spring 140 is strong enough to enable flag 115 to fully extend while not being overly powerful so it operates smoothly and efficiently. An alternate embodiment of the present invention may be implemented without a compression spring. In this embodiment a user manually slides the trigger lever attached to the flagpole up into the upright position and back down into the retracted position. This embodiment comprises a second safety lock at the top of the slot in the housing unit into which the trigger lever is inserted to hold the flagpole in the upright position.

In the present embodiment, almost the entire structure of flag assembly 100 is made from aluminum to resist water damage and to promote a longer life, in addition to being attractive. However in alternate embodiments, some or all of the parts may be made from different materials, for example, without limitation, different metals or plastic.

In typical use of the present embodiment, a user attaches flag assembly 100 to a boat using clamp 135. Trigger lever 125 is pushed down into the safety lock to lock flag 115 in the retracted position. As a skier or tuber participates in a water sport while connected to the boat, flag 115 remains in the retracted position. If the skier or tuber falls into the water, the user removes trigger lever 125 from the safety lock and compression spring 140 forces flagpole 120 and flag 115 up and out of housing unit 105 by pressing against the lower flagpole guide. Once the skier or tuber is safely out of the water, the user pushes trigger lever 125 back down into the safety lock to pull flagpole 120 and flag 115 back into housing unit 105 and into the retracted position.

Figure 2:
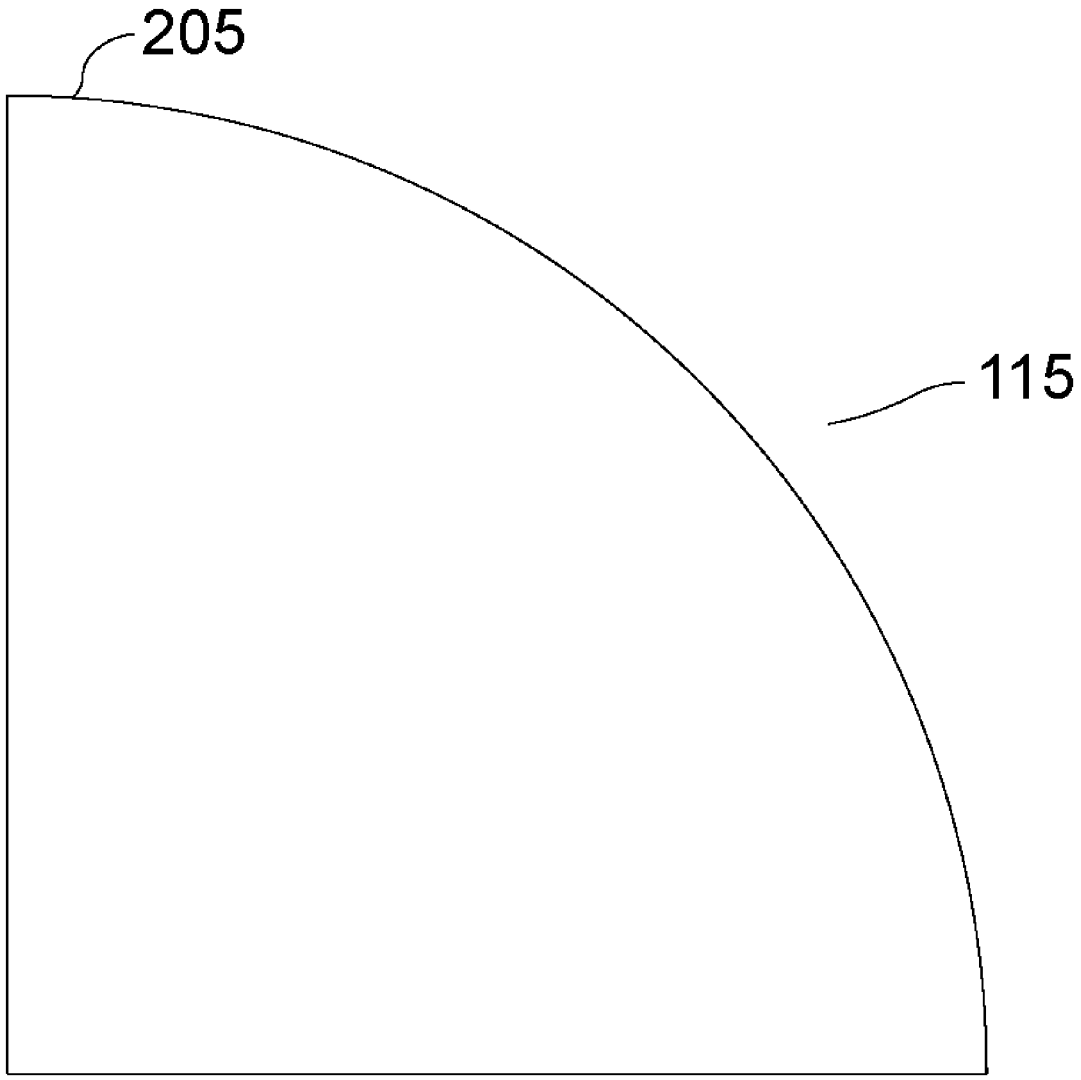
FIG. 2 is a diagrammatic side view of an exemplary flag for a retractable caution flag assembly, in accordance with an embodiment of the present invention.

FIG. 2 is a diagrammatic side view of an exemplary flag 115 for a retractable caution flag assembly, in accordance with an embodiment of the present invention. In the present embodiment, flag 115 is 12 inches by 12 inches in size when installed on a flagpole and is orange in color to meet legal requirements. Flag 115 is preferably made of polyester nylon material; however other materials may be suitable such as, but not limited to, cotton, silk or plastic. Flag 115 has a 1¼-inch overhang 205, which is rolled over and sewn down the length of flag 115. This creates a pocket into which the flagpole may be inserted for installation. Flag 115 may be glued or otherwise adhered to the flagpole to generally ensure stability when flag 115 is in motion. The rest of the material creating flag 115 is cut in a radius to better fit inside the housing unit while not in operation; however, in alternate embodiments the flag may have a different shape such as, but not limited to, a square, a rectangle, a triangle, etc. Those skilled in the art, in light of the present teachings, will readily recognize that alternate embodiments of the present invention may be implemented for purposes other than a water safety caution flag such as, but not limited to, other types of signal flags on boats, flags in other sporting events, road construction flags, etc. In these alternate embodiments the flag may be virtually any size, shape or color.

Figure 3A:
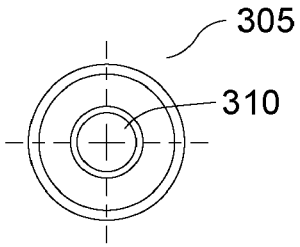
FIGS. 3A and 3B illustrate an exemplary lower flagpole guide for a retractable caution flag assembly, in accordance with an embodiment of the present invention.
Figure 3B:
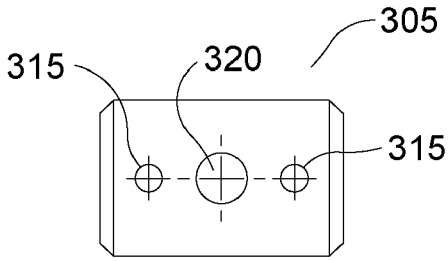

FIGS. 3A and 3B illustrate an exemplary lower flagpole guide 305 for a retractable caution flag assembly, in accordance with an embodiment of the present invention. FIG. 3A is a diagrammatic top view, and FIG. 3B is a diagrammatic side view. In the present embodiment, lower flagpole guide 305 is preferably made of aluminum with all edges cut at 45 degree angles for smother operating; however, lower flagpole guide 305 may be made of various different materials including, but not limited to, other types of metal, plastic, rubber, etc. It is lower flagpole guide 305 into which the trigger lever screws in order to move the flagpole up and down. Lower flagpole guide 305 is sized to fit inside the housing unit and has hole 310 in the center into which the flagpole can be inserted. Lower flagpole guide 305 has two ⅛-inch holes 315 and a ¼-inch, threaded hole 320 drilled into its side. Holes 315 are designed so that when flagpole 120 is first inserted into hole 310, flagpole 120 can be drilled with a ⅛" bit through holes 315 and ⅛"roll-pins can be inserted into holes 315 to lock flag pole to guide 305. The trigger lever screws into hole 320 in order to operate the flagpole. In alternate embodiments, the trigger lever may be attached to the lower flagpole guide using various different means such as, but not limited to, welding, bolts, screws, etc. In the present embodiment, lower flagpole guide 305 is set at the bottom of the flagpole and a ⅛-inch stainless steel roll pin is inserted through one of holes 315 to hold lower flagpole guide 305 in place. In alternate embodiments the lower flagpole guide may be held in place on the flagpole using various different means including, but not limited to, welding, set screws, etc. In the present embodiment, an upper flagpole guide similar to lower flagpole guide 305 without a hole for the trigger lever is located 13 inches from the top end of the flagpole. The upper flagpole guide may be located in different places on the flagpole depending on factors such as, but not limited to, the size of the flagpole, the size of the flag, etc. Furthermore, alternate embodiments of the present invention may be implemented without an upper guide on the flagpole or with more than two flagpole guides. The upper and lower flagpole guides help the flagpole move between the upright position and the retracted position smoothly. However, those skilled in the art, in light of the present teachings, will readily recognize that various other means may be used to accomplish this such as, but not limited to, roller bearings. Some alternate embodiments may be implemented without flagpole guides of any type. In these embodiments the trigger lever is attached directly to the flagpole and the flagpole fits snuggly inside the housing unit while still being able to slide up and down. Lubricants may be used in these embodiments to aid in the movement of the flagpole within the housing unit.

Figure 4:
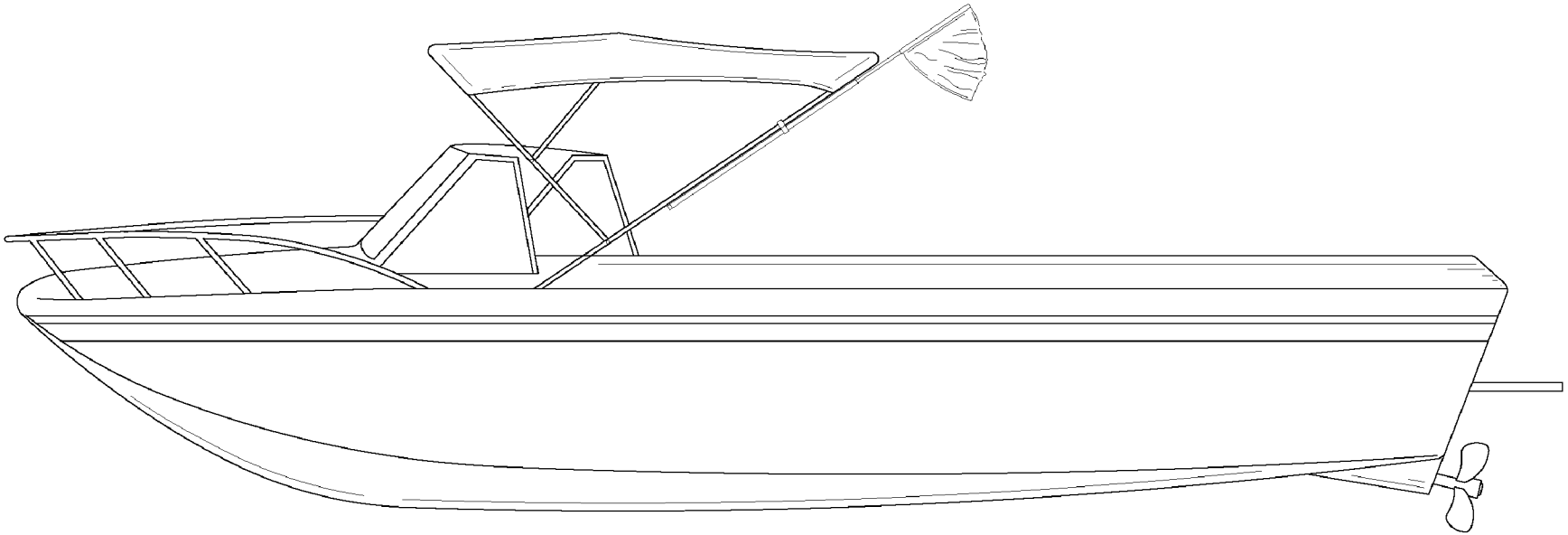
FIG. 4 is a diagrammatic side view of an exemplary caution flag assembly mounted to a boat, in accordance with an embodiment of the present invention.

FIG. 4 is a diagrammatic side view of an exemplary caution flag assembly 100 mounted to a boat 400, in accordance with an embodiment of the present invention. In the present embodiment, flag assembly 100 is attached to a bimini top 405 of boat 400 with two clamps 135. However, users of embodiments of the present invention can easily mount the assembly to their boats wherever they want, making embodiments of the present invention more attractive to more people.

Those skilled in the art, in light of the present teachings, will readily recognize that alternate embodiments of the present invention may enable the user to raise and lower the flag using means other than a spring-loaded mechanism. For example, without limitation, one alternate embodiment may be implemented with a push button mechanism rather than a manual trigger. Other alternate embodiments may be motorized versions of the flagpole assembly. Yet another alternate embodiment may comprise a screw type flagpole with a worm gear.

Having fully described at least one embodiment of the present invention, other equivalent or alternative methods of providing a retractable caution flag according to the present invention will be apparent to those skilled in the art. The invention has been described above by way of illustration, and the specific embodiments disclosed are not intended to limit the invention to the particular forms disclosed. For example, the particular implementation of the flag assembly may vary depending upon the particular type of mounting object being used. The flag assemblies described in the foregoing were directed to boat-mounted implementations; however, similar techniques are to mount retractable caution flags on different types of objects. For example, without limitation, retractable flags may be mounted to construction vehicles at a worksite or traffic signals or signs. Retractable flags may also be mounted to various types of sporting equipment for example, without limitation, a soccer or hockey goal to indicate when a player scores or the finish line of a race to indicate when a racer finishes. Non boat-mounted implementations of the present invention are contemplated as within the scope of the present invention. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. An apparatus comprising:

a housing unit having a hollow cylinder shape with a first end and a second end;

a pole for movement within said housing unit;

means, fixedly joined to said pole proximate a bottom end of said pole, for guiding movement of said pole hi-directionally within said housing;

means, fixedly joined to said pole proximate a longitudinal midpoint of said pole, for guiding smooth movement of said pole within said housing unit;

means for conveying information joined proximate an end of said pole;

means for joining the apparatus to a pole structure of a bimini top of a water sports boat; and means for driving said pole to display said conveying means.

2. The apparatus as recited in claim 1, further comprising means for enabling said driving means and for constraining movement of said pole to a longitudinal length.

3. The apparatus as recited in claim 1, further comprising means for retaining said pole from protruding said housing unit.

4. An apparatus comprising:

a housing unit having a hollow cylinder shape with a first end and a second end;

a flagpole having a first flagpole end and a second flagpole end for insertion of said second flagpole end into said first end, and for movement within said housing unit, where said flagpole is completely contained within said housing unit at a first position;

a flag for conveying information, said flag being joined to said flagpole proximate said first flagpole end;

at least two bracket assemblies being configured to be operable for joining the apparatus longitudinally to a pole structure of a bimini top of a water sports boat;

an upper guide fixedly joined to said flagpole proximate a longitudinal midpoint of said flagpole and lubricated for smooth movement of said flagpole within said housing unit;

a driving element disposed proximate said second end of said housing unit for driving said flagpole in at least a first direction to a second position partially out of said housing unit to display said flag; and a lower guide fixedly joined to said flagpole proximate said second flagpole end, in engagement with said driving element, and lubricated for guiding smooth movement of said flagpole.

5. The apparatus as recited in claim 4, further comprising a trigger element for enabling said driving element to move said flagpole from said first position to said second position.

6. The apparatus as recited in claim 4, further comprising an end cap joinable to said first end for retaining said flagpole within said housing unit.

7. The apparatus as recited in claim 5, wherein said driving element comprises a compressible element.

8. The apparatus as recited in claim 7, wherein said housing unit further comprises a longitudinal slot and a short section of slot situated at a right angle to said longitudinal slot, and said trigger element further comprises a trigger lever joined to said lower guide and extending through said longitudinal slot, where a longitudinal movement of said trigger element is constrained by said longitudinal slot, and a placement of said trigger lever in said short section of slot prevents said compressible element from moving said flagpole.

9. The apparatus as recited in claim 8, wherein said compressible element is a spring.

10. The apparatus as recited in claim 4, wherein said flag is a caution flag.

11. An apparatus comprising:

a housing unit having a hollow cylinder shape with a first end, a second end, a longitudinal slot and a short section of slot situated at a right angle to said longitudinal slot;

a flagpole having a first flagpole end and a second flagpole end for insertion of said second flagpole end into said first end, and for movement within said housing unit, where said flagpole is completely contained within said housing unit at a first position;

an end cap removably joinable to said first end for retaining said flagpole within said housing unit during storage of the apparatus;

a lower guide fixedly joined to said flagpole proximate said second flagpole end and lubricated for guiding movement of said flagpole, said lower guide further comprising angled distal edges;

an upper guide fixedly joined to said flagpole proximate a longitudinal midpoint of said flagpole and lubricated for smooth movement of said flagpole within said housing unit, said upper guide further comprising angled distal edges;

a flag for conveying caution information, said flag being joined to said flagpole proximate said first flagpole end;

at least two bracket assemblies being configured to be operable for joining the apparatus longitudinally to a pole structure of a bimini top of a water sports boat;

a compressible spring disposed within said housing unit proximate said second end and in engagement with said lower guide for driving said flagpole in a first direction to a second position partially out of said housing unit to display said flag;

a generally flat bottom end cap comprising a drain hole and removably joined to said second end for securing said compressible spring and enabling drainage of water from said housing;

a trigger lever joined to said lower guide and extending through said longitudinal slot where a longitudinal movement of said trigger element is constrained by said longitudinal slot, and a placement of said trigger lever in said short section of slot prevents said compressible spring from moving said flagpole.

* * * * *